US006554032B2

(12) United States Patent
Pallmann

(10) Patent No.: US 6,554,032 B2
(45) Date of Patent: Apr. 29, 2003

(54) APPARATUS FOR SLICING FIBROUS MATERIAL, IN PARTICULAR, TRUNK WOOD

(75) Inventor: Wilhelm Pallmann, Zweibrücken (DE)

(73) Assignee: Pallmann Maschinenfabrik GmbH & Co. KG, Zweibrücken (DE)

( * ) Notice: Subject to any disclaimer, the term of this patent is extended or adjusted under 35 U.S.C. 154(b) by 0 days.

(21) Appl. No.: 09/915,769

(22) Filed: Jul. 26, 2001

(65) Prior Publication Data

US 2002/0144750 A1 Oct. 10, 2002

(30) Foreign Application Priority Data

Apr. 4, 2001 (DE) ..... 101 16 691

(51) Int. Cl.[7] ..... B27C 1/00

(52) U.S. Cl. ..... 144/172; 144/42; 144/162.1; 144/174

(58) Field of Search ..... 241/92, 228, 278.2; 144/162.1, 172, 174, 176, 373, 180, 42, 43

(56) References Cited

U.S. PATENT DOCUMENTS 3,324,909 A * 6/1967 McCranie ..... 144/162.1
3,913,643 A * 10/1975 Lambert ..... 144/163
4,470,442 A * 9/1984 Krautzberger et al. ..... 144/42
5,274,899 A * 1/1994 Sentagnes et al. ..... 144/162.1
5,485,873 A * 1/1996 Crammond ..... 144/172
5,964,264 A * 10/1999 Kokko ..... 144/172
6,390,161 B1 * 5/2002 Freitag et al. ..... 144/162.1

* cited by examiner

*Primary Examiner*—W. Donald Bray
(74) *Attorney, Agent, or Firm*—Friedrich Kueffner

(57) ABSTRACT

An apparatus for slicing elongate fibrous material has a slicing device having an axis of rotation about which the slicing device rotates during operation. The slicing device has slicing tools with a blade carrier and a blade unit. The blade units have cutting blade edges that together define a common cutting surface. The elongate fibrous material is fed in slicing cycles in the direction of its longitudinal extension to the blade units. Slicing is carried out parallel to the fiber orientation by realizing a relative movement between the elongate fibrous material and the blade units transverse to the fiber orientation. The slicing tools have an end face with a receptacle extending parallel to the end face. The slicing tools have a cutting element arranged in the receptacle. The cutting element performs a separating cut in a direction transverse to the fiber orientation in the separating plane between two slicing cycles.

20 Claims, 4 Drawing Sheets

APPARATUS FOR SLICING FIBROUS MATERIAL, IN PARTICULAR, TRUNK WOOD

BACKGROUND OF THE INVENTION

1. Field of the Invention

The invention relates to an apparatus for slicing fibrous feed material, in particular, trunk wood. The apparatus comprises a slicing device which rotates about an axis and is, for example, in the form of a blade ring, a blade shaft, or a blade disk, wherein the slicing device comprises slicing tools each comprising a blade carrier and a blade unit. The cutting blade edge of the blade units define a common cutting blade edge circle or a common cutting blade edge plane. The feed material is supplied in working cycles in the direction of its longitudinal axis to the blade units. Slicing is carried out in a direction parallel to the fiber orientation by producing a relative movement transverse to the fiber orientation between the feed material and the blade units. On the end face of the slicing tools, respectively, a cutting element acting transverse to the fiber orientation is arranged for producing a separating cut in a separating plane between two slicing cycles.

2. Description of the Related Art

In the utilization of wood as a basic construction material, structural parts which are comprised of glued wood chips or strands are becoming more and more import as a result of their greater and more constant strength across their length as well as their shape stability. These structural parts include, for example, OSB (oriented strand board) products. These structural parts furthermore have the advantage that high-quality products can be produced from recycled wood or trunk wood of lesser quality, wherein an almost complete utilization of the starting material is possible.

For producing the strands or flakes as the starting material for such structural parts, it is known to employ slicing devices comprising blade rings, blade shafts and blade disks comprising slicing blades. These devices have in common that the cutting edges of the slicing blades are arranged on a common cutting edge circle or a cutting edge plane which the cutting edges describe when the device is rotated. By performing a relative movement between the feed material and the slicing device, the cutting blade edges are brought into engagement with the feed material such that the cutting blade edges are parallel to the fiber orientation of the feed material.

It is conventional in connection with feed material having substantially only a longitudinal extension, such as, for example, trunk wood, to perform the slicing operation in cycles. In this connection, the trunks are combined to a bundle with parallel fiber orientation and are fed with their end facing the slicing device in the axial direction into the slicing space while being supported at the opposite end outside of the slicing space. By generating a relative movement between the trunk wood and the slicing tools, the slicing action takes place and the length of the trunk wood is shortened by the depth of the slicing space. The next portion of the wood bundle is then fed into the slicing space, and a new working cycle begins.

The quality and the properties of the final product are greatly affected by the geometry of the flakes or strands used in their manufacture. In order to ensure constant material properties, it is necessary to employ strands of uniform dimensions with boundary surfaces that are as smooth as possible. The slicing geometry is determined by the amount of radial projection of the cutting edge into the slicing space, which determines the strand thickness, as well as the spacing of the cutting edges relative to the strand breaking strip which is recessed relative to the cutting edge and which determines the width of the strand.

The determination of the length of the strand is realized by providing so-called scoring members which carry out a leading cut transverse to the fiber orientation with their radially acting cutting edges before the strand is lifted off by the subsequent slicing blade. The scoring members are arranged in the immediate area of the blade carriers and the slicing blades and are positioned circumferentially in radial planes which are staggered in the direction of the depth of the slicing space, wherein the axial spacing of two radial planes determines the length of the strand.

Problems when using such scoring members are caused by the more-than-average great loading during operation of the slicing apparatus in combination with the requirement to embody the scoring members as narrow as possible in order to maintain the flank pressure in the area of the cutting edge of the scoring member as small as possible. In order to provide a satisfactory solution in this connection, it is known to design the scoring members as thin as possible and to arrange them in precisely fitting slots within the blade carrier so that only the cutting edges project past the slot. The positive-locking securing action on both sides results in a rigid clamping action of the scoring member which protects the scoring member from being overloaded in a direction transverse to its plane. This arrangement of the scoring member however is possible only over the length of the slicing blade or the blade carrier, but is not possible on the end faces of a slicing blade because, as a result of the construction, support on both sides of the scoring member is not possible.

Experiments have shown that the known scoring members, when arranged at the end face of a slicing blade, cannot withstand the load acting thereon so that they will bend or even break off. The broken-off scoring members can enter in certain situations the slicing space and carry therefore the considerable risk of damaging the slicing apparatus.

For this reason, known slicing devices, in general, are not provided with scoring members at the end faces of the slicing blade. Instead, one relies upon the fibers at the end faces of the strand to be torn off during slicing in the separating plane between two working cycles. However, this results in frayed end faces and different lengths of the strands thus produced with disadvantageous effects on maintaining a predetermined strand geometry and thus strand quality. Further disadvantageous after effects are the unsteady running of the apparatus and increased energy consumption.

For the purpose of eliminating these disadvantages, slicing blades whose end faces are provided with an auxiliary blade have already been used. The purpose and object of such an auxiliary blade is to cut off the final strand of a slicing cycle. Even though with this measure the afore described problems could be decreased, the problems could not be solved entirely.

SUMMARY OF THE INVENTION

It is an object of the present invention to generate a clean separating cut in the separating plane between two working cycles.

In accordance with the present invention, this is achieved in that the slicing tools have a spacial receptacle or recess for the cutting element, wherein the receptacle or recess is arranged parallel to the plane of the end face of the slicing tools.

Preferably, the cutting element has a thickness of at least 4 mm, preferably 5 mm, with a flank slant angle relative to the longitudinal axis of 20°–30°.

Moreover, the blade unit is characterized in that at the end face of the blade unit a recess is arranged for the cutting element which acts perpendicularly to the slicing blade of the blade unit.

By providing a cutting element according to the invention on the end face of the blade unit, the invention overcomes the prejudice of the prior art configurations that scoring members can be arranged only across the length of the slicing blade but not permanently on its end face. Positioning of the scoring members on the end faces in accordance with the invention has the advantage that the strands to be manufactured can also be cut in the separating plane between two working cycles. This results in an improvement of the strand quality because all the boundary surfaces have a smooth surface so that strands with a uniform geometry can be produced.

The slicing action which is realized completely by means of cutting ensures moreover a more quiet running of the apparatus with reduced wear of the slicing tools. Since the work when slicing the strands is not as great as when chipping, there is furthermore the advantage that the inventive slicing apparatus has a reduced energy consumption.

According to the invention, the slicing tools have at their end face a receptacle or recess, respectively, in which the cutting element is arranged, respectively. The receptacles or recesses are formed of at least two surfaces which are matched to the outer shape of cutting element. Accordingly, at least two abutment surfaces for the cutting element are provided which are able to receive the great forces which result during operation of the apparatus according to the invention. This contributes to a significant improvement of the attachment of the cutting elements on the slicing tools.

Instead of a receptacle in the form of a recessed step, it is also possible to provide a shoulder formed at the end face of the blade unit or the blade carrier and projecting therefrom for forming a receptacle. However, a combination of a recessed step with a shoulder is also possible. The unitary shoulder, which according to a further advantageous embodiment can extend up to the outwardly facing side of the cutting element, forms an additional abutment surface and, moreover, an additional protection against mechanical stress of the cutting element as well as against soiling in the area of the cutting element.

According to an advantageous embodiment of the invention, the receptacle encloses the upper side, the lower side, the back side and one of the two lateral sides of the cutting element. This results in an almost complete enclosure of the cutting element and ensures an especially good attachment of the cutting element on the slicing tools and, at the same time, an optimal protection against the penetration of dirt.

A further advantageous embodiment of the invention provides that the receptacle with regard to its depth is smaller than the thickness of the cutting element. This has the result that the cutting element with its outer lateral side projects past the end face of the slicing tool. In this way, the friction surface of the rotating slicing tools relative to the feed material is reduced to a minimum in the plane of the separating cut.

Depending on the configuration of the blade units, the receptacle can be formed partially or entirely by the blade unit. According to a preferred embodiment, the receptacle is formed by the blade unit and the blade carrier. In this connection, the cutting element is arranged with the upper and lower sides between the slicing blade and the wear protection of the blade carrier, wherein the blade holding plate fixedly attached to the slicing blade generates the spacing between the slicing blade and the blade carrier which matches the height of the cutting element.

In this context, it is particularly advantageous when the thickness of the blade holder plate is slightly thinner than the height of the cutting element. When mounting the cutting element, a clamping action is realized which ensures an especially fast and safe securing of the cutting element on the slicing tools.

According to an advantageous embodiment, the cutting element according to the invention has a reduced cutting edge projection length in comparison to the remaining scoring members. By this measure, the inherent high loading of the cutting elements resulting from their configuration is at least partially compensated.

A preferred cutting element according to the invention has a minimum thickness of 4 mm with a maximum flank slant angle of 30°. This geometry ensures a sufficient own stability in connection with a still acceptable flank pressure.

Such a geometry of the cutting element is of particular importance in connection with a reduced cutting edge projection because the combination of these two features counteracts the flank pressure which increases with increasing thickness of the cutting element.

In a further embodiment according to the invention, the cutting element has its cutting edge arranged external to its center plane wherein the flank slant angle to both sides of the cutting edge has the same absolute value. In this way, the friction between the rotating slicing tools and the stationary feed material can be lowered further in that the separating plane between two slicing cycles can be moved farther into the outer area of the slicing tools.

DESCRIPTION OF THE PREFERRED EMBODIMENTS

Figure 1:
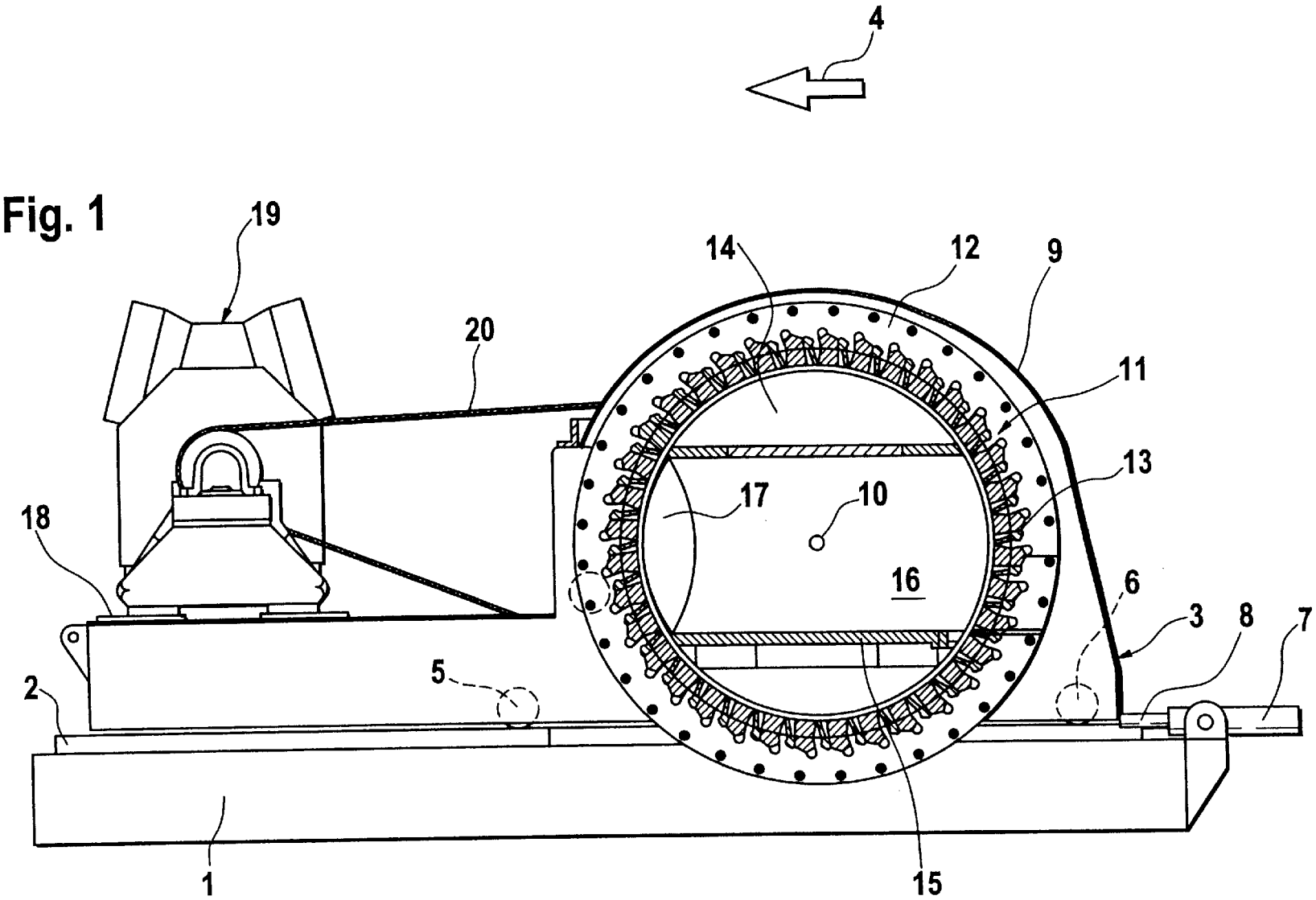
FIG. 1 is a longitudinal section of the slicing apparatus comprising a blade ring.

FIG. 1 shows in a simplified illustration the most important elements of a slicing apparatus with blade ring. The slicing apparatus with blade ring has a support frame 1 that is fixedly connected to the floor. At the upper side of the support frame 1 rails 2 are arranged and extend horizontally in the plane of the illustration. The rails 2 serve for providing a movement path for a carriage 3 for performing a lateral movement 4. For this purpose, the carriage 3 has wheels 5, 6 at its underside which roll on the rails 2. Also, a cylinder-piston unit 7 is provided which is arranged rigidly on the support frame 1 and initiates with its moveable part 8 the lateral movement 4 of the carriage.

Within the housing 9 a blade ring 11 is arranged on the carriage 3 and is freely rotatably supported about a horizontal axle 10 extending transversely to the rails 2. The blade ring 11 is comprised of two support rings 12 arranged coaxially and at a spacing to one another, wherein only the support ring 12 to the back is illustrated in the drawing. The two support rings 12 are connected to one another by a plurality of blade carriers 13 which are positioned axis parallel and uniformly distributed about the circumference of the support rings 12 so that they enclose a circular disk-shaped space. The circular disc-shaped space has in its upper area a top segment 14 and in the lower area a bottom element 15 which bot delimit with their surfaces facing the axle 10 the slicing space 16 in which the actual slicing work is carried out.

A counter abutment 17 projects into the slicing space 16 which is open at its end face. The counter abutment 17 has a convex cross-section and is stationarily arranged relative to the support frame 1 and the floor so that it does not follow the lateral movement 4 of the carriage 3.

The carriage 3 has a platform 18 arranged laterally of the blade ring 11 on which the drive unit 19 is arranged which effects the rotation of the blade ring 11. The drive unit 19 is connected by a belt 20 to a multi-groove pulley (not shown) arranged on the rearward end of the axle 10 and rigidly connected by means of a shaft with the blade ring 11.

Figure 2:
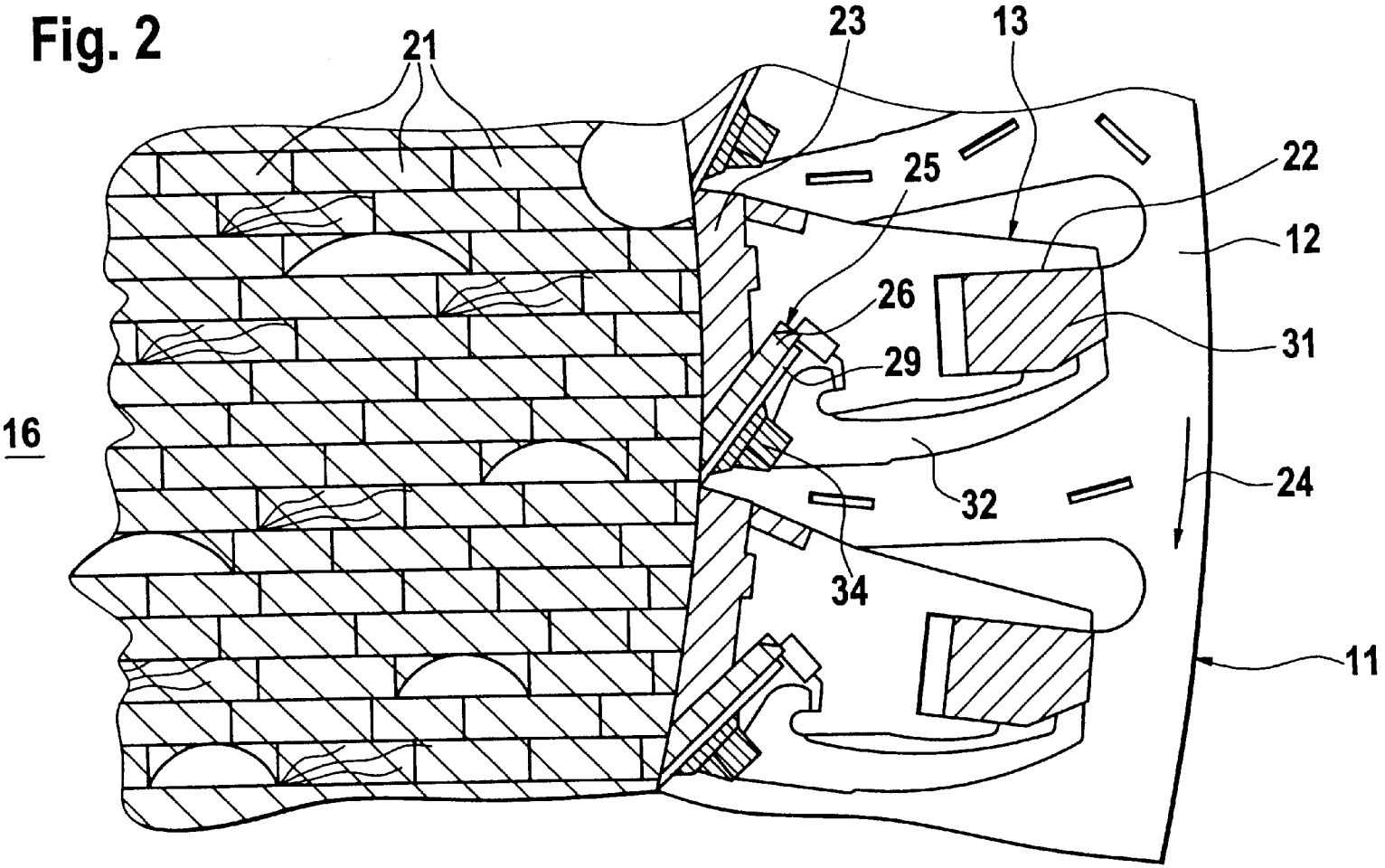
FIG. 2 is a part-sectional view of the apparatus illustrated in FIG. 1 in the area of the blade ring with adjoining slicing space.

In FIG. 2 a detail of the slicing apparatus in the area of the blade ring 11 and also of the slicing space 16 is illustrated. The slicing space 16 is filled with wood elements 21 aligned parallel to the axle 10 and bundled with parallel fiber orientation. The wood elements 21 are secured in this position external to the slicing apparatus in a separate device and project with their free end into the slicing space 16. The support ring 12 of the blade ring 11 is illustrated, showing the blade carriers 13 arranged circularly about the axle 10 and projecting perpendicularly from the side surface of the ring 12. Each blade carrier 13 is comprised of a base support 22 which is provided with a wear protection 23 at the base thereof facing the slicing space 16. At its leading edge in the rotational direction 24, the blade carrier 13 has a slot-shaped cutout for receiving a blade unit 25 according to the invention.

Figure 5:
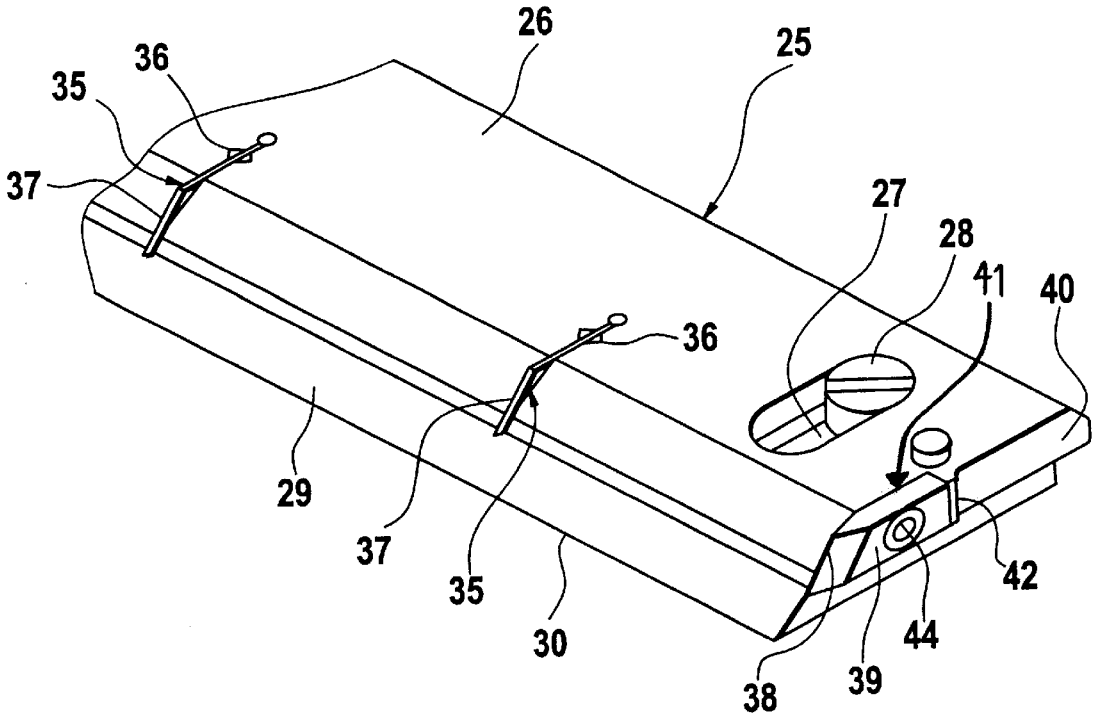
FIG. 5 is a perspective view of a blade unit according to the invention.

A more detailed configuration of the blade unit 25 can be seen in particular in FIG. 5. The blade unit 25 comprises a blade holding plate 26 which is fixedly connected with the slicing blade 29 by means of screws 28 received in slotted holes 27. The slotted holes 27 make possible an adjustment of the slicing blade 29, required as a result of wear, external to the blade carrier 13 so that the cutting blade edges 30 of the slicing blades 29 are at all times adjustable to the required cutting edge projection. Accordingly, a common cutting circle of the cutting blade edges 30 is provided which is identified in FIG. 3 with reference numeral 45. When an exchange is necessary, the blade unit 25 configured in this way is inserted in a fast and simple way from the end face in the axial direction into the cutout of the blade carrier 13. A correct slicing angle and cutting edge projection will result by means of defined contact and support surfaces in the slot-shaped cutout.

Securing of the blade unit 25 in this position is realized by using the centrifugal forces that result during the slicing action. The centrifugal forces which are caused by the rotation of the blade ring 11 force the centrifugal wedge 31, which is moveably arranged in the blade carrier 13, radially outwardly and, in turn, the centrifugal wedge 31 pushes on one arm of a two-arm rocking lever 32 so that the other arm of the rocking lever 32, with interposition of the clamping strip 33 and a slicing breaker strip 34, pushes on the blade unit 25.

Since, without providing further inserts, the described apparatus would produce strands of the length that corresponds to the depth of the slicing space, radially acting scoring members 35 are arranged across the length of the blade unit 25 at an axial spacing to one another. For this purpose, the blade holding plate 26 has slots 36 provided on its leading longitudinal edge in the rotational direction 24 into which the scoring members 35 are exchangeable inserted with only their cutting edge 37 projecting from the slots. The axial spacing between the scoring members 35 defines the length of the strands to be produced. In the rotational direction 24 all of the scoring members 35 of the blade carriers 25 are positioned on a common cutting edge circle. The scoring members 35 have a sufficiently great cutting edge projection into the slicing space 16 and ensure thus a leading cut transverse to the fiber of the feed material 21 before the slicing blades 29 remove a strand.

Figure 3:
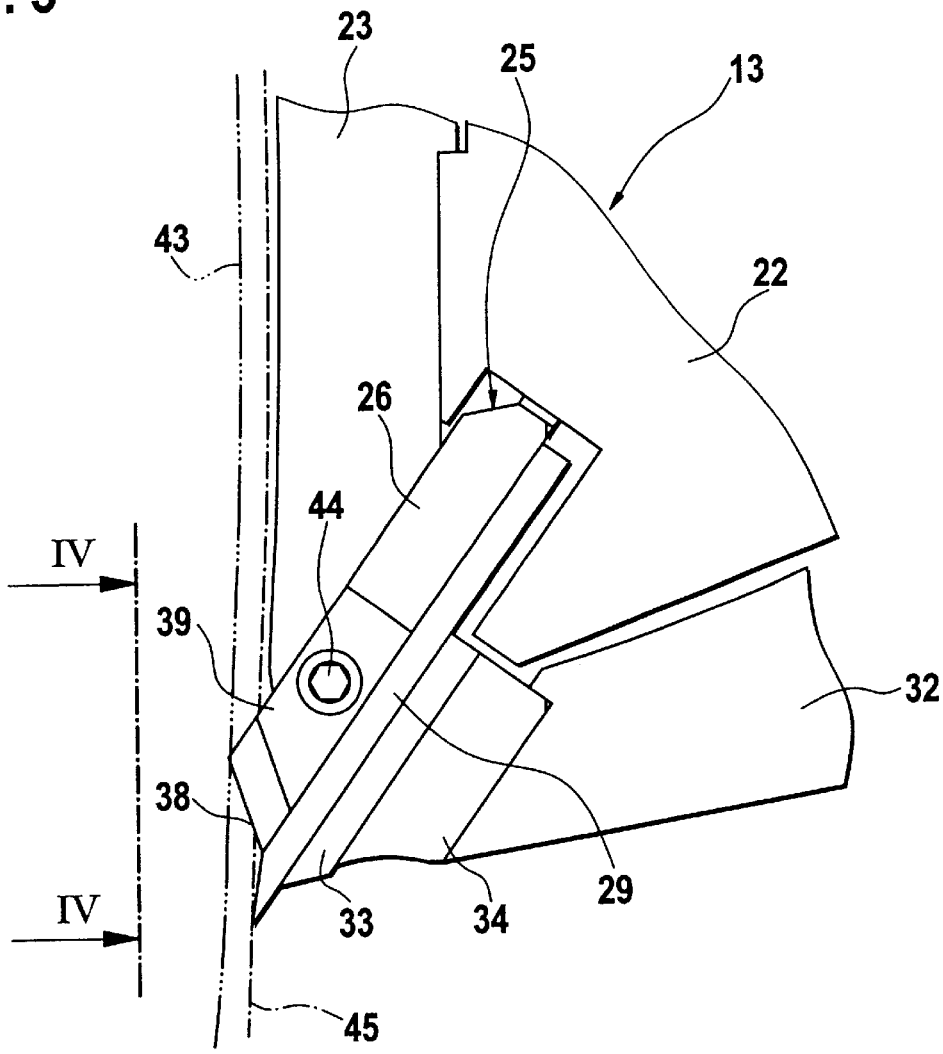
FIG. 3 is a detail view of the blade carrier illustrated in FIG. 2.
Figure 4:
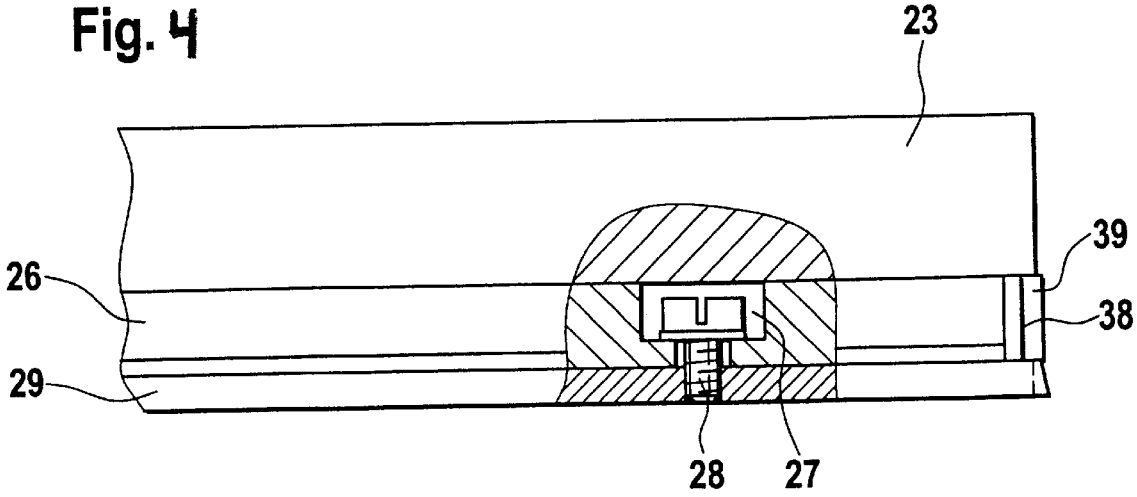
FIG. 4 is a part sectional view along the view line IV—IV of the blade carrier illustrated in FIG. 3.

In order to be able to cut the strands to a predetermined length at the separating plane between two working cycles, the apparatus according to the invention has a cutting element 39 at the end face 40 of the blade units 25, respectively, as is illustrated in more detail in FIGS. 3, 4, and 5. For this purpose, the blade holding plate 26 has at the leading part of the end face 40 in the rotational direction 24 an inwardly recessed step 41 which provides a receptacle for the cutting element 39 and which has formed thereat, projecting in the outward direction, a shoulder 42 (FIG. 5) ending flush with the surface. The recess 41 and the shoulder 42 form a common support surface for the cutting element 39 and provide together with the blade holding plate 26 a protected receptacle for the cutting element 39.

The cutting element 39 is secured by a countersunk screw 44 in the above described receptacle 41. The screw 44 serves only for a positional securing of the cutting element 39 in the receptacle. Since the cutting element 39 extends over the entire height of the blade holding plate 26, the force introduction is realized primarily via the blade carrier 13, in particular, its wear protection 23, and the slicing blade 29 between which the cutting element 39 is clamped in the operational state (FIGS. 3 and 4).

Figure 6:
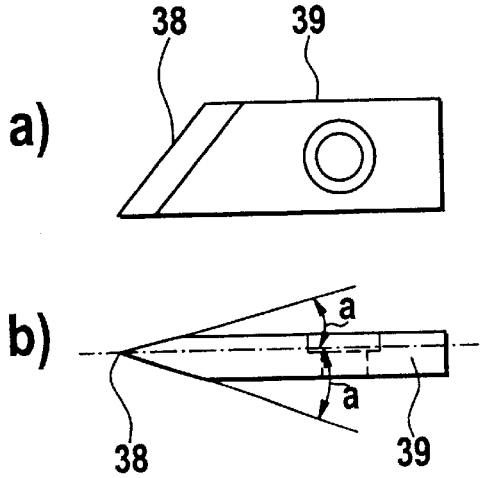
FIG. 6*a* is a side view of the cutting element according to the invention.
FIG. 6*b* is a bottom view of the cutting element according to the invention.

The special configuration of the cutting element 39 according to the invention is illustrated in detail in FIGS. 6*a* and 6*b*. The cutting element 39 has a thickness of 5 mm. The flank slant angle $\alpha$ relative to the longitudinal axis or plane of the cutting element 39 is 25° in the present example. In this way, the cutting element 39 has a sufficient stability in order to withstand the mechanical stress during the slicing operation. In order to keep the flank pressure as low as possible, the cutting elements 39 can have a reduced cutting edge projection of, for example, of 2.5 mm, in comparison to the scoring members 35. In FIG. 3, the cutting edge circle of the cutting element 39 is identified with reference numeral 43.

While specific embodiments of the invention have been shown and described in detail to illustrate the inventive principles, it will be understood that the invention may be embodied otherwise without departing from such principles.

What is claimed is:

1. An apparatus for slicing elongate fibrous material comprised of fibers, wherein the elongate fibrous material has a longitudinal direction and wherein the fibers have a fiber orientation extending in the longitudinal direction of the elongate fibrous material, the device comprising:

a slicing device having an axis of rotation about which the slicing device rotates during operation;

the slicing device comprising slicing tools comprising a blade carrier and a blade unit;

the blade units having cutting blade edges wherein the cutting blade edges together define a common cutting surface, wherein the elongate fibrous material is fed in the direction of longitudinal extension to the blade units and slicing is carried out in a direction parallel to the fiber orientation by carrying out a relative movement between the elongate fibrous material and the blade units transverse to the fiber orientation;

the slicing tools having an end face with a receptacle, wherein the receptacle extends parallel to the end face;

the slicing tools comprising a cutting element arranged in the receptacle, wherein the cutting element is configured to perform a separating cut in a direction transverse to the fiber orientation in a separating plane between two slicing cycles.

2. The apparatus according to claim 1, wherein the receptacle is formed of at least two surfaces angularly positioned relative to one another.

3. The apparatus according to claim 1, wherein the cutting element has a cutting edge, a back side opposite the cutting edge, an upper side and a lower side extending from the cutting edge to the back side, respectively, and two opposed lateral sides, wherein the receptacle is configured to cover at least partially the upper side, the lower side, the back side and one of the lateral sides of the cutting element, respectively.

4. The apparatus according to claim 3, wherein the receptacle has a depth that is smaller than a thickness of the cutting element defined by a spacing of the two opposed lateral side relative to one another.

5. The apparatus according to claim 3, wherein the end face of the slicing tools has a shoulder defining a rearward end of the receptacle, respectively, for receiving the back side of the cutting element.

6. The apparatus according to claim 5, wherein the shoulder has an outwardly facing side and wherein the cutting element and the outwardly facing side of the shoulder are flush with one another.

7. The apparatus according to claim 1, wherein the receptacle is formed at least partially by parts of the blade unit.

8. The apparatus according to claim 1, wherein the receptacle is formed by parts of the blade unit and partially by the blade carrier.

9. The apparatus according to claim 8, wherein the parts of the blade unit comprise a blade holding plate and a slicing blade, wherein the receptacle is formed by the slicing blade, the blade holding plate, and the blade carrier.

10. The apparatus according to claim 3, wherein the cutting element has a height defined by a spacing of an upper side and a lower side of the cutting element relative to one another, wherein the receptacle has a height that is minimally smaller than the height of the cutting element.

11. The apparatus according to claim 1, wherein the cutting element has a fastener configured to secure the cutting element in a proper position thereof in the receptacle, respectively.

12. The apparatus according to claim 1, wherein the cutting element has a cutting edge projection of 2 to 4 mm.

13. The apparatus according to claim 1, wherein the cutting edge projection is 2.5 to 3 mm.

14. The apparatus according to claim 1, wherein the cutting element has a cutting edge that is formed by flanks having a flank slant angle of 20° to 30° relative to a longitudinal axis of the cutting element and wherein the cutting element has a thickness of at least 4 mm.

15. The apparatus according to claim 14, wherein the thickness of the cutting element is at least 5 mm.

16. The apparatus according to claim 1, wherein the cutting element has a cutting edge and is asymmetrical in that the cutting edge is positioned relative to a longitudinal center plane of the cutting element closer to a lateral side facing away from the slicing tool.

17. A cutting element for an apparatus according to claim 1, wherein the cutting element has a cutting edge formed by flanks having a flank slant angle of 20° to 30° relative to a longitudinal axis of the cutting element and has a thickness of at least 4 mm.

18. The cutting element according to claim 17, wherein the thickness is at least 5 mm.

19. The cutting element according to claim 17, wherein the cutting edge is asymmetrically positioned relative to a longitudinal center plane of the cutting element.

20. A blade unit for the apparatus according to claim 1, having an end face having a receptacle, wherein the receptacle is configured to receive a cutting element, which cutting element acts perpendicularly to a cutting blade edge of the blade unit.

* * * * *